US009468293B2

(12) United States Patent
Yang

(10) Patent No.: US 9,468,293 B2
(45) Date of Patent: Oct. 18, 2016

(54) COMBINED RACK WITH AN ADJUSTABLE WIDTH

(71) Applicant: ULIKE CORPORATION, New Taipei (TW)

(72) Inventor: Jui-Lien Yang, New Taipei (TW)

(73) Assignee: ULIKE CORPORATION, New Taipei (TW)

( * ) Notice: Subject to any disclaimer, the term of this patent is extended or adjusted under 35 U.S.C. 154(b) by 42 days.

(21) Appl. No.: 14/227,817

(22) Filed: Mar. 27, 2014

(65) Prior Publication Data

US 2014/0291266 A1 Oct. 2, 2014

(30) Foreign Application Priority Data

Mar. 27, 2013 (TW) ..... 102110978 A

(51) Int. Cl.
*A47F 3/14* (2006.01)
*A47B 96/00* (2006.01)
(Continued)

(52) U.S. Cl.
CPC ..... *A47B 96/00* (2013.01); *A47B 88/0014* (2013.01); *A47B 96/025* (2013.01); *A47F 3/147* (2013.01); *A47F 5/0025* (2013.01);
(Continued)

(58) Field of Classification Search
CPC .. A47B 96/00; A47B 88/00; A47B 88/0014; A47B 2210/04; A47B 2088/0037; A47B 47/00; A47B 96/02; A47B 96/025; A47B 2088/0448; A47B 88/0451; A47B 88/20; A47B 2031/003; A47B 31/00; A47B 43/003; A47B 46/00; A47B 47/021; A47B 73/002; A47B 61/02; A47B 2051/005; A47L 15/50; A47L 15/507; A47L 15/501; A47F 5/0025; A47F 3/06; A47F 3/147; A47F 5/0018; A47F 5/0031; A47F 5/0043; A47F 5/0081; A47F 5/0093; A47F 5/01; A47F 5/10; A47F 5/13
USPC ..... 211/85.29, 126.15, 88.04, 133.5, 162, 211/153, 46; 312/348.1, 348.2, 330.1, 312/334.6
See application file for complete search history.

(56) References Cited

U.S. PATENT DOCUMENTS 2,635,779 A * 4/1953 Pfeiffer ..... F25D 25/022 220/23.88
4,527,694 A * 7/1985 Bolt ..... H05F 3/02 211/162

(Continued)

FOREIGN PATENT DOCUMENTS

TW 571687 U 1/2004
TW 395406 U 1/2011

(Continued)

*Primary Examiner* — Jennifer E Novosad
(74) *Attorney, Agent, or Firm* — Maschoff Brennan

(57) ABSTRACT

A combined rack for connecting two sliding rails includes a front plate, a back plate, a left component, a right component and a carrying component. The front plate, the back plate, the left component, the right component and the carrying component together form an accommodation space. The left component and the right component are used for being installed on the two sliding rails respectively, in a slidable manner. The carrying component includes a carrying member, a front combining component and a back combining component. The lower edge of the front plate includes a back support structure, and the front combining component and the back combining component on opposite two sides of the carrying component are installed on the front support structure and the back support structure respectively.

14 Claims, 8 Drawing Sheets

(51) Int. Cl.

| | |
|---|---|
| ***A47F 5/00*** | (2006.01) |
| ***A47B 96/02*** | (2006.01) |
| ***A47B 88/00*** | (2006.01) |
| *A47B 88/04* | (2006.01) |
| *A47B 31/00* | (2006.01) |

(52) U.S. Cl.
CPC ..... *A47F5/0031* (2013.01); *A47F 5/0093* (2013.01); *A47B 2031/003* (2013.01); *A47B 2088/0037* (2013.01); *A47B 2088/0488* (2013.01); *A47B 2210/04* (2013.01)

(56) References Cited

U.S. PATENT DOCUMENTS 4,807,764 A * 2/1989 Bellin ..... A47B 88/0407 211/118
5,205,630 A * 4/1993 Welch ..... A47B 47/021 108/107
5,213,403 A * 5/1993 Lautenschlager .. A47B 88/0422 312/140
5,405,020 A * 4/1995 Fotioo ..... B42F 15/0094 211/189
5,515,980 A * 5/1996 Fotioo ..... B42F 15/0094 211/189
5,588,729 A * 12/1996 Berger ..... A47B 88/0422 312/330.1
6,166,916 A * 12/2000 Jelinger ..... H05K 7/1417 206/706
6,443,544 B1 * 9/2002 Wolf ..... A47B 88/20 312/263
6,491,173 B1 * 12/2002 Costa ..... A47B 88/0422 211/126.15
6,578,720 B1 * 6/2003 Wang ..... A47F 5/01 211/126.15
6,938,784 B2 * 9/2005 Yang ..... A47B 88/00 211/87.01
7,108,143 B1 * 9/2006 Lin ..... A47B 88/04 211/126.15
7,448,508 B2 * 11/2008 Babucke ..... F24C 15/16 211/126.9
7,497,533 B2 * 3/2009 Remmers ..... A47B 57/42 108/108
7,597,203 B2 * 10/2009 Jasniy ..... A47F 5/0892 211/117
7,832,568 B2 * 11/2010 Wu ..... A47B 81/04 211/85.29
8,590,992 B2 * 11/2013 Lim ..... A47B 88/20 312/348.3
8,671,712 B2 * 3/2014 Noel ..... F25D 25/025 312/330.1
8,782,962 B1 * 7/2014 Schoewe ..... A47B 88/0455 52/27
8,960,822 B1 * 2/2015 Hsu ..... A47B 88/16 312/334.4
2007/0235401 A1 * 10/2007 Costa ..... A47F 3/147 211/126.15
2014/0291266 A1 * 10/2014 Yang ..... A47B 96/00 211/126.15

FOREIGN PATENT DOCUMENTS

TW 414139 U 10/2011
TW 444799 U 1/2013

* cited by examiner

COMBINED RACK WITH AN ADJUSTABLE WIDTH

CROSS-REFERENCE TO RELATED APPLICATIONS

This non-provisional application claims priority under 35 U.S.C. §119(a) on Patent Application No(s). 102110978 filed in Taiwan, R.O.C. on Mar. 27, 2013, the entire contents of which are hereby incorporated by reference.

TECHNICAL FIELD

The disclosure relates to a rack, more particularly to a combined rack with adjustable widths.

BACKGROUND

The left and right sides of a combined rack are usually equipped with a sliding rail respectively to enable itself to be pulled out from the cabinet or be pushed into the cabinet. The combined rack comprises at least two sliding-sleeve members, multiple side components (on the front side as well as the back side) and a carrying member. The sliding-sleeve members are sleeved on the two sliding rails respectively. The sliding rail is disposed on the cabinet and the sliding-sleeve member usually has a connecting portion corresponding to the side component of the combined rack and a sliding groove for the sliding rail to be disposed on. Thereby, the sliding-sleeve member can be installed on the combined rack and can move relative to the sliding rail so that the combined rack may be pulled out or be pushed in.

Since the carrying member of the combined rack is installed on the sliding-sleeve members on the left and right sides, one combined rack cannot fit all cabinets with different accommodation spaces. Moreover, if the width of the combined rack does not match the cabinet, the accommodation space of the cabinet cannot be fully utilized.

SUMMARY

A combined rack for connecting two sliding rails comprises a front plate, a back plate, a left component, a right component and a carrying component. The front plate, the back plate, the left component, the right component and the carrying component together form an accommodation space. The left component and the right component are configured for being installed on the two sliding rails respectively, in a slidable manner. The carrying component comprises a carrying member, a front combining component and a back combining component. The lower edge of the front plate comprises a back support structure, and the front combining component and the back combining component on opposite two sides of the carrying component are installed on the front support structure and the back support structure respectively.

BRIEF DESCRIPTION OF THE DRAWINGS

The present disclosure will become more fully understood from the detailed description and the drawings given herein below for illustration only, and thus does not limit the present disclosure, wherein.

DETAILED DESCRIPTION

Figure 1:
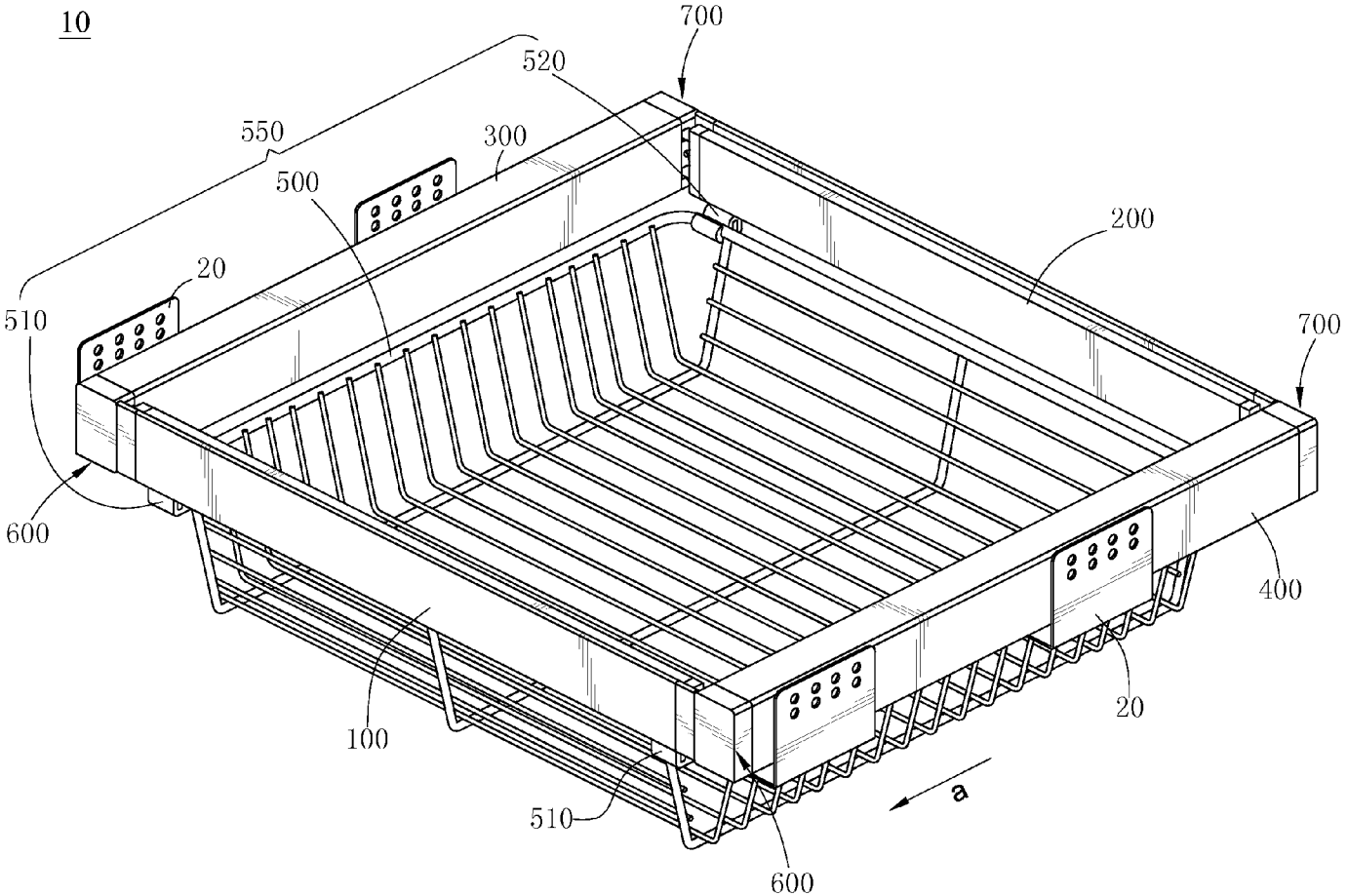
FIG. 1 is a perspective view of a combined rack according to the first embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
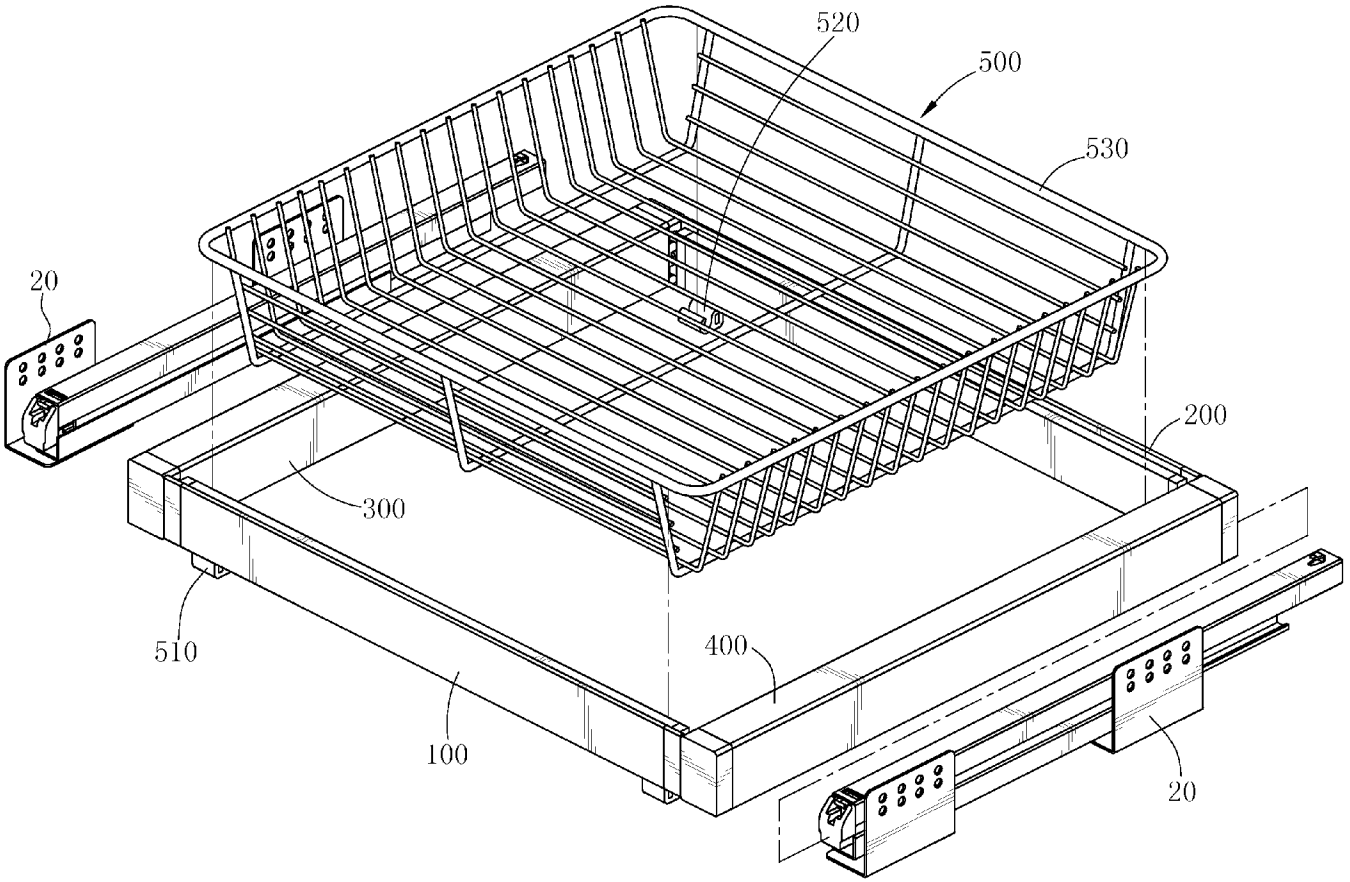
FIG. 2 is a partial exploded view of FIG. 1.
Figure 3:
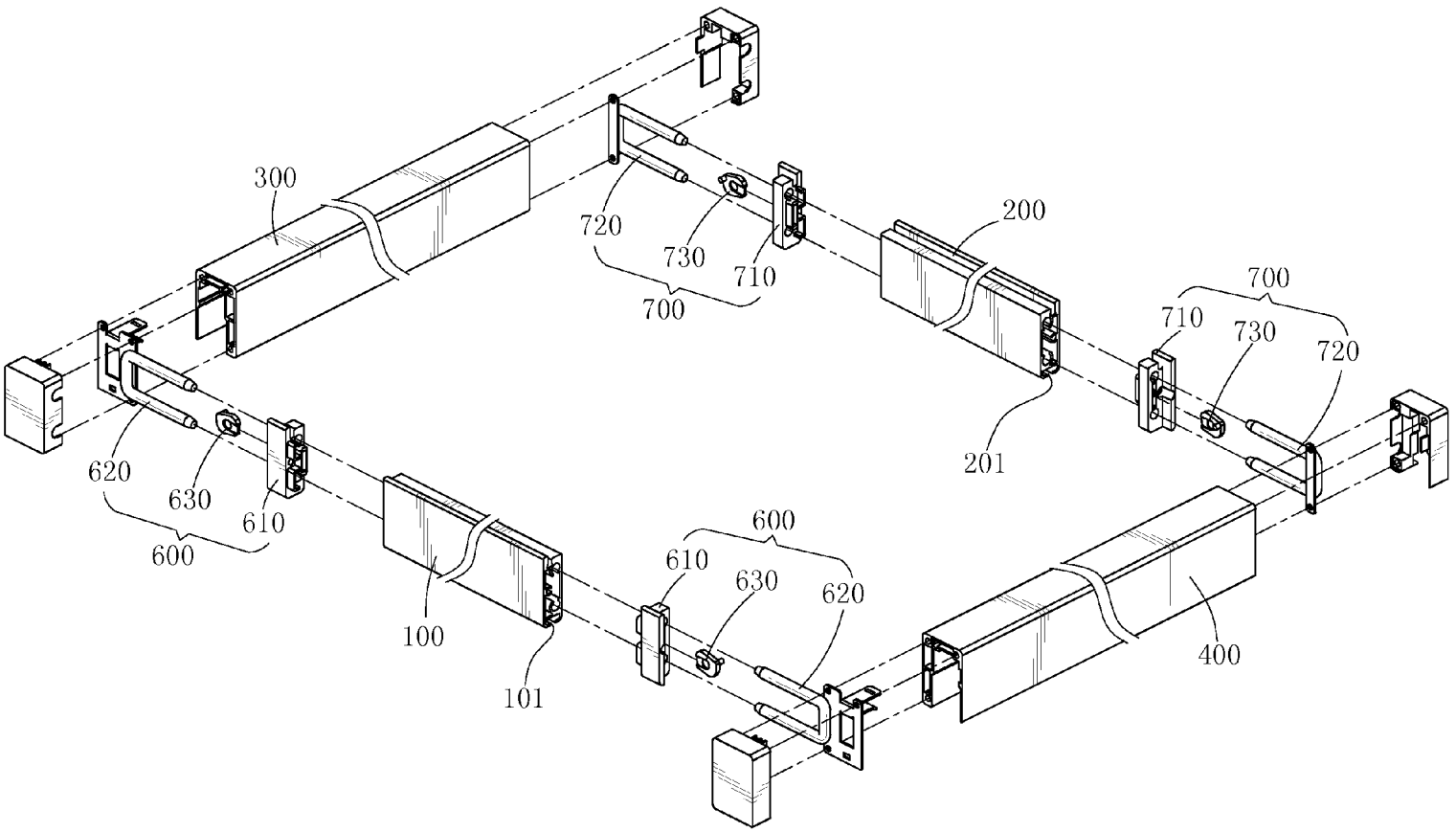
FIG. 3 is a perspective view of the front plate, the back plate, the left component and the right component of FIG. 2.
Figure 4:
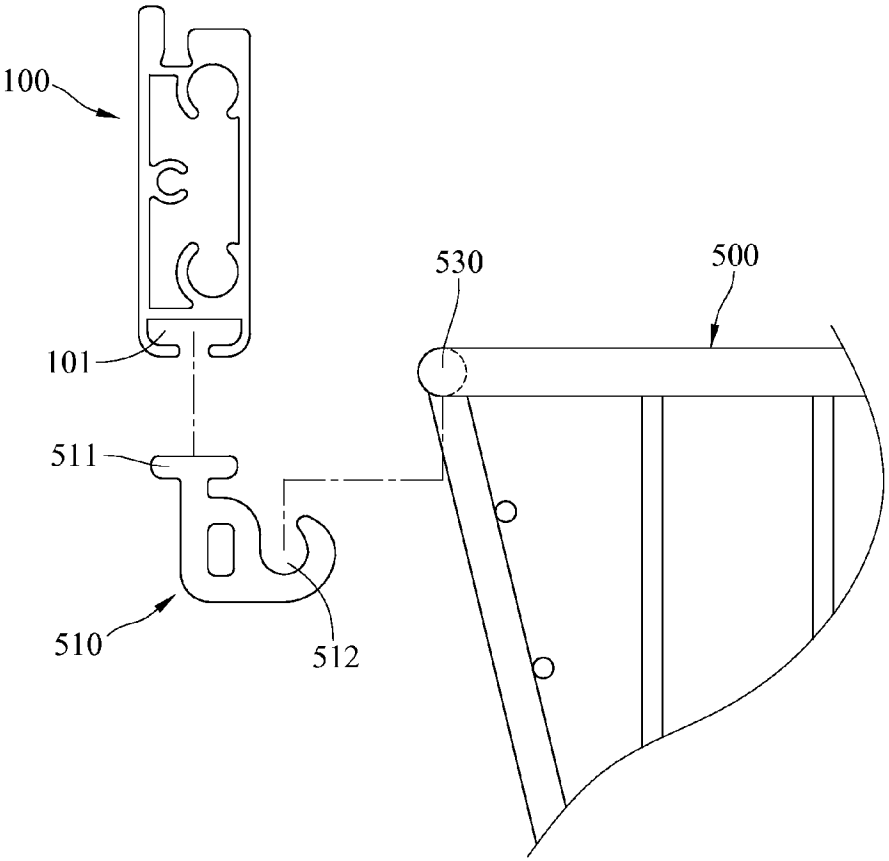
FIG. 4 is a partial plan view of the front plate and the carrying component of FIG. 3.

FIG. 1 is a perspective view of a combined rack according to the first embodiment of the disclosure; FIG. 2 is a partial exploded view of FIG. 1; FIG. 3 is a perspective view of the front plate, the back plate, the left component and the right component of FIG. 2; FIG. 4 is a partial plan view of the front plate and the carrying component of FIG. 3. As seen in FIG. 1 to FIG. 4, the combined rack 10 of this embodiment comprises a front plate 100, a back plate 200, a left component 300, a right component 400 and a carrying component 550. Additionally, the combined rack 10 further comprises two first connecting assemblies 600 and two second connecting assemblies 700.

The front plate 100, the back plate 200, the left component 300, the right component 400 and the carrying component 550 together form an accommodation space. The front plate 100 and the back plate 200 are located on opposite two sides of the carrying component 550 respectively. The left component 300 and the right component 400 are located on opposite two sides of the carrying component 550 respectively. The left component 300 and the right component 400 is respectively configured for being slidably installed on the two sliding rail 20 which are configured for being fixed to a cabinet (not shown in the figures). Thereby, the combined rack 10 may slide relative to the sliding rail 20 along the extending direction of the left component 300 (namely the direction of arrow a).

The lower edge of the front plate 100 comprises a front support structure 101 while the lower edge of the back plate 200 comprises a back support structure 201. In this embodiment, the front support structure 101 and the back support structure 201 are both grooves.

The carrying component 550 comprises a plurality of front combining components 510 and a plurality of back combining components 520. The opposite two sides of the front combining component 510 each comprises a first combining portion 511 and a second combining portion 512. The opposite two sides of the back combining component 520 each comprises a third combining portion 521 and a fourth combining portion 522. The front plate 100 and the back plate 200 may be hollow plates or solid plates. Furthermore, in other embodiments, the number of the front combining component 510 and that of the back combining component 520 may both be one. In other embodiments, the front combining component 510 and the back combining component 520 may be connected to the front plate 100 and the back plate 200.

In this embodiment, the first combining portion 511 and the third combining portion 521 are respectively a block. The front support structure 101 and the back support structure 201 (namely two fastening grooves) are fastened with the first combining portion 511 and the third combining portion 521 (namely two blocks). In other words, the front combining component 510 is disposed on the front support structure 101 of the lower edge of the front plate 100 while the back combining component 520 is disposed on the back support structure 201 of the lower edge of the back plate 200.

Moreover, the second combining portion 512 and the fourth combining portion 522 are respectively a hook. In this embodiment, the carrying member 500 is a rack consisting of a plurality of rods while opposite two sides of the carrying member 500 comprises a rod 530 respectively. The two rods 530 are hooked at the second combining portion 512 and the fourth combining portion 522 (namely two hooks) respectively.

The two first connecting assemblies 600 each comprise a first connecting member 610, a second connecting member 620 and a first fixing member 630. The two first connecting members 610 are disposed on opposite two ends of the front plate 100. The two second connecting members 620 are disposed on the left component 300 and the right component 400 respectively and are movably combined with the two first connecting members 610 respectively. The two first fixing members 630 are respectively pivoted on the two first connecting members 610. The first fixing member 630 may move relative to the first connecting member 610 and therefore has a fixed position and an adjusted position. The first fixing member 630 at the fixed position is used for fixing the relative position between the first connecting member 610 and the second connecting member 620 while the first fixing member 630 at the adjusted position is for releasing the fastening connection between the first connecting member 610 and the second connecting member 620 so that it may adjust the relative position of the first connecting member 610 and the second connecting member 620.

The two second connecting assemblies 700 each comprises a third connecting member 710, a fourth connecting member 720 and a second fixing member 730. The two third connecting members 710 are disposed on opposite two ends of the back plate 200 respectively. The two third connecting members 710 are disposed on opposite two ends of the back plate 200. The two fourth connecting members 720 are disposed on the left component 300 and the right component 400 respectively. The two fourth connecting members 720 are movably combined with the two third connecting members 710 respectively. The two second fixing member 730 are pivoted on the two third connecting members 710 respectively. The second fixing member 730 is configured for moving relative to the third connecting member 710 and thus has a fixed position and an adjusted position. The second fixing member 730 at the fixed position is used for fixing the relative position between the third connecting member 710 and the fourth connecting member 720 while the second fixing member 730 at the adjusted position is for releasing the fastening connection between the third connecting member 710 and the fourth connecting member 720 so that it may adjust the relative position of the first connecting member 610 and the second connecting member 620. Thereby, the width between the left component 300 and the right component 400 can be adjusted.

In this embodiment, the first connecting assemblies 600 and the second connecting assemblies 700 are disposed on the front plate 100 and the back plate 200 respectively, but the disclosure is not limited thereto. In other embodiments, the first connecting assemblies 600 and the second connecting assemblies 700 may sleeve on outside of the front plate 100 and the back plate 200.

In the past, the support grooves for the carrying component 550 to combine with is disposed on the left component 300 and the right component 400. By comparison, it is now moved to the bottom part of the front plate 100 and the back plate 200 so the left component 300 and the right component 400 are not combined with the carrying component 550. As a result, when the width between the left component 300 and the right component 400 needs to be adjusted, the combined rack 10 is not limited by the size of the carrying component 550. In other words, users may adjust the width between the left component 300 and the right component 400 to fully utilize the accommodation space of the combined rack 10. Additionally, after the combined rack 10 is disassembled, the package size of the combined rack 10 can be minimized for reducing packaging and shipping costs of the combined rack 10.

Figure 5:
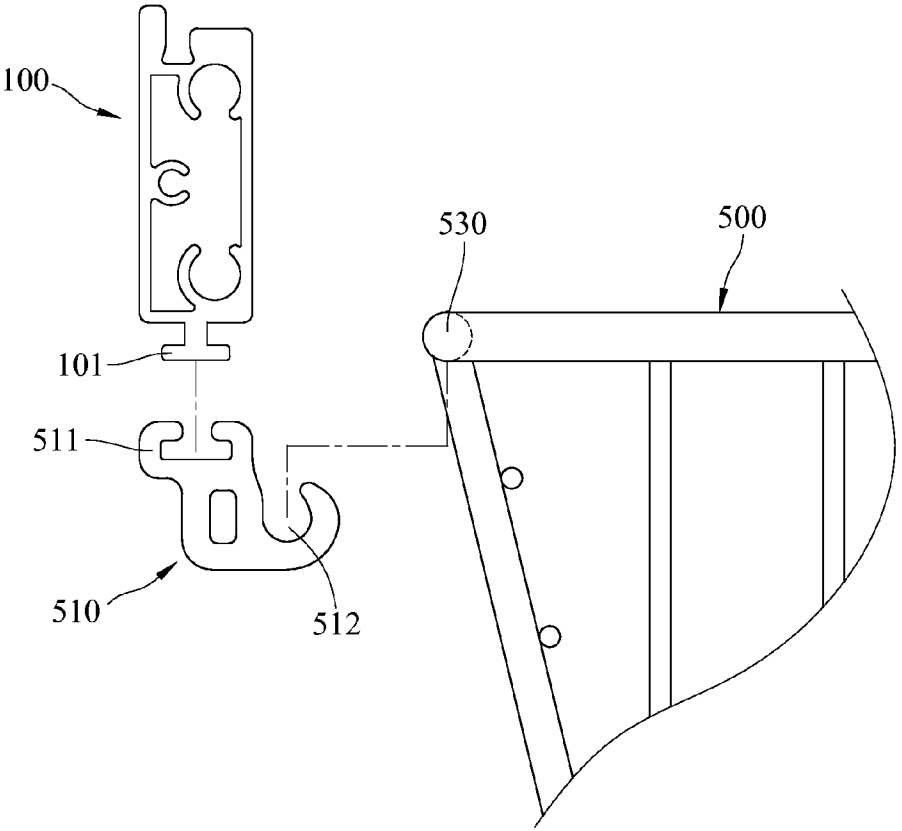
FIG. 5 is a partial plan view of the front plate and the carrying component according to the second embodiment of the disclosure.

In FIG. 4, the first combining portion 511 and the third combining portion 521 are respectively a block while the front support structure 101 and the back support structure 201 are fastening grooves but the disclosure is not limited thereto. In other embodiments, these components can be designed as fastening structures matching each other, which is shown in FIG. 5. FIG. 5 is a partial plan view of the front plate and the carrying component according to the second embodiment of the disclosure. As seen in FIG. 5, this embodiment is similar to that of FIG. 4 and only the meaningful differences will be illustrated. Besides, the change of the front combining component 510 and the back combining component 520 are similar so only the change of the front combining component 510 will be illustrated.

In this embodiment, the carrying component 550 comprises a front combining component 510 and a back combining component 520. The opposite two sides of the front combining component 510 comprises a first combining portion 511 and a second combining portion 512 respectively. In this embodiment, the first combining portion 511 is a fastening groove and the front support structure 101 and the back support structure 201 are both blocks. The front support structure 101 is fastened with the first combining portion 511 so that the front combining component 510 and the front plate 100 are combined with each other. In other embodiments, the first combining portion 511 may be a hook.

Figure 6:
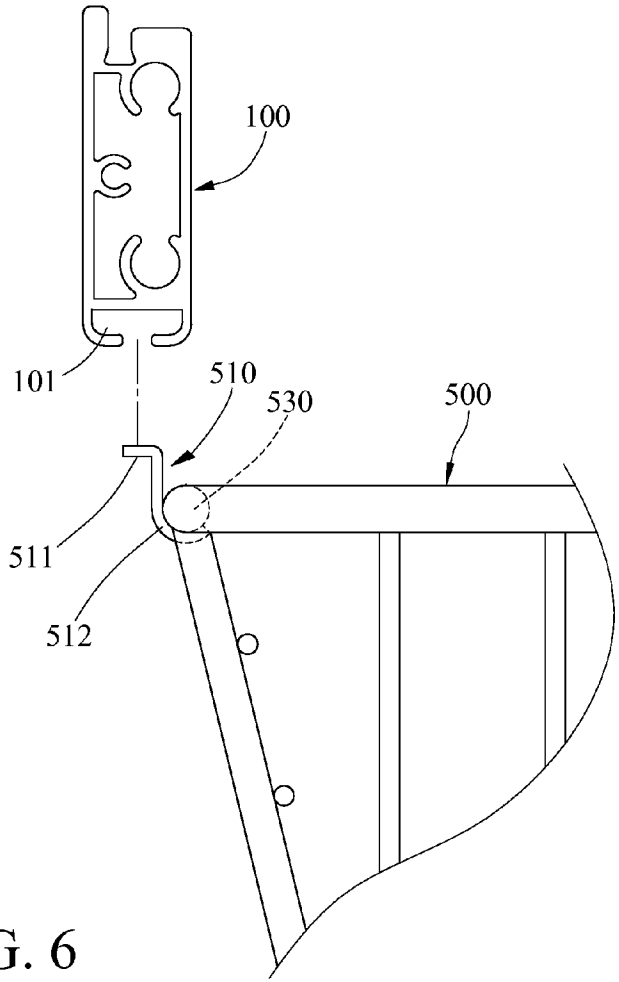
FIG. 6 is a partial plan view of the front plate and the carrying component according to the third embodiment of the disclosure.

FIG. 6 is a partial plan view of the front plate and the carrying component according to the third embodiment of the disclosure. As seen in FIG. 6, this embodiment is similar to that of FIG. 4 and only the meaningful differences will be illustrated. Besides, the change of the front combining component 510 and the back combining component 520 are similar so only the change of the front combining component 510 will be illustrated.

In this embodiment, the carrying component 550 comprises the front combining component 510 and the back combining component 520. The opposite two sides of the front combining component 510 comprises a first combining portion 511 and a second combining portion 512 respectively. In this embodiment, the first combining portion 511 is a hook and the front support structure 101 and the back support structure 201 are both fastening grooves. The front support structure 101 is fastened with the first combining portion 511 (the hook). In this embodiment, the second combining portion 512 of the front combining component 510 is fixed to the carrying member 500 by welding, but it is not limited thereto. In other embodiment, the second combining portion 512 of the front combining component 510 may be fixed to the carrying member 500 by screwing.

Though the front combining component 510 and the carrying member 500 mentioned before are not integrally formed and the back combining component 520 and the carrying member 500 mentioned before are not integrally formed, the disclosure is not limited thereto. In other embodiments, the front combining component 510 and the back combining component 520 may be integrally connected to the opposite two sides of the carrying member 500 respectively.

Figure 7:
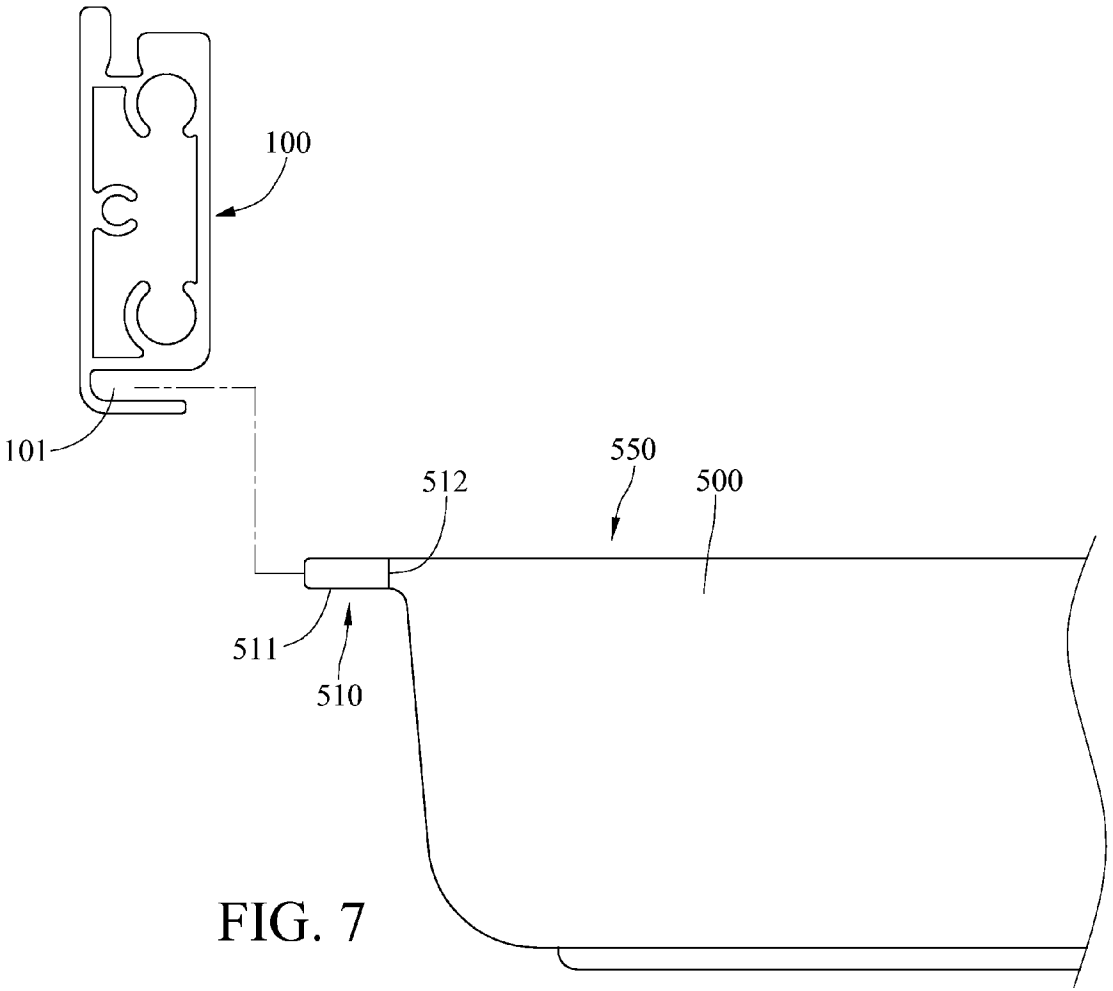
FIG. 7 is a partial plan view of the front plate and the carrying component according to the fourth embodiment of the disclosure.

FIG. 7 is a partial plan view of the front plate and the carrying component according to the fourth embodiment of the disclosure. As seen in FIG. 7, the combined rack 10 of this embodiment comprises a front plate 100, a back plate 200, a left component 300, a right component 400 and a carrying component 550. The front plate 100, the back plate 200, the left component 300, the right component 400 and the carrying component 550 together form an accommodation space.

Specifically, the lower edge of the front plate 100 comprises a front support structure 101 while the lower edge of the back plate 200 comprises a back support structure 201. The carrying member 500 comprises a carrying member 500, a front combining component 510 and a back combining component 520. The opposite two sides of the carrying component 550 are installed on the front support structure 101 and the back support structure 201 respectively. In this embodiment, the front support structure 101 and the back support structure 201 are grooves (or fastening grooves), and the carrying component 550 is a storage box. The front combining component 510 on the front side of the carrying component 550 and the back combining component 520 on the back side of the carrying component 550 are installed on the front support structure 101 and the back support structure 201, but the disclosure is not limited thereto. In other embodiments, the carrying component 550 may be a plate or a basket.

Figure 8:
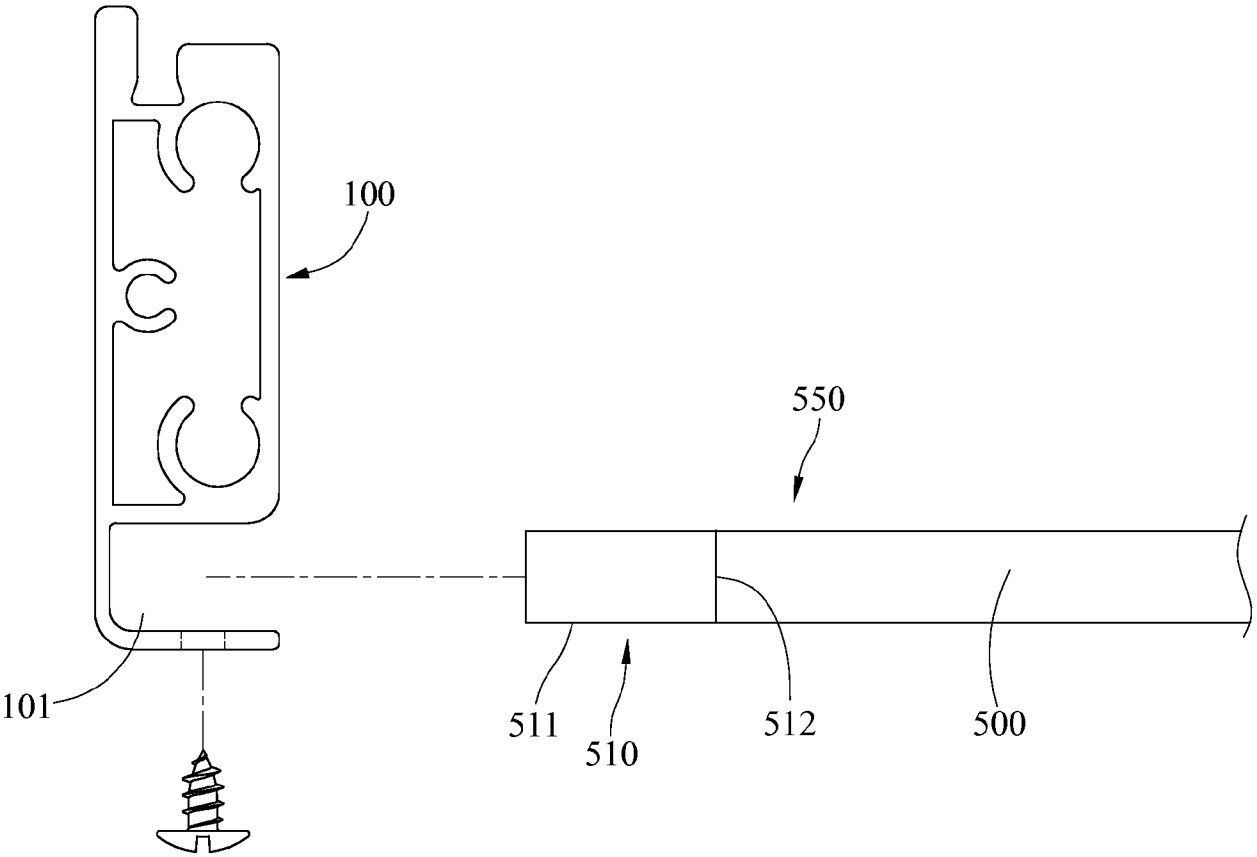
FIG. 8 is a partial plan view of the front plate and the carrying component according to the fifth embodiment of the disclosure.

FIG. 8 is a partial plan view of the front plate and the carrying component according to the fifth embodiment of the disclosure. As seen in FIG. 6, this embodiment is similar to that of FIG. 4 and only the differences, namely the structure of the carrying component 550, will be illustrated. In this embodiment, the carrying component 550 is a plate and comprises a carrying member 500, a front combining component 510 and a back combining component 520. The front side and the back side of the carrying member 500 are connected to the front combining component 510 and the back combining component 520 respectively. The lower edges of the front plate 100 and the back plate 200 comprise a front support structure 101 and a back support structure 201 respectively. The front combining component 510 and the back combining component 520 are installed on the front support structure 101 and the back support structure 201 respectively but they are not limited thereto. In other embodiments, the front support structure 101 and the back support structure 201 are support sheets.

Moreover, the structure of the back plate can be different from that of the front plate but both of them have support grooves on their bottom parts for the carrying component to be installed on.

In the combined rack of the disclosure, the support structure for carrying component to be installed on are now moved to the bottom parts of front and back components. Thereby, the left and right components are no longer combined with the carrying component. As a result, when the width between the left and right components needs to be adjusted, the combined rack is not limited by the size of the carrying component. In other words, users may adjust the width between the left and right components easily to fully utilize the accommodation space of the combined rack.

Additionally, after the combined rack of the disclosure is disassembled, the package size thereof can be minimized for reducing the packaging and shipping costs.

What is claimed is:

1. A combined rack for connecting two sliding rails, comprising a front plate, a back plate, a left component, a right component and a carrying component, wherein the front plate, the back plate, the left component, the right component and the carrying component together form an accommodation space, the left component and the right component are configured for being installed on the two sliding rails respectively, in a slidable manner, the carrying component comprises a carrying member, a front combining component and a back combining component, a lower edge of the front plate comprising a front support structure, a lower edge of the back plate comprises a back support structure, the front combining component and the back combining component are connected to the carrying member, and the front combining component and the back combining component are installed on the front support structure and the back support structure, respectively;

wherein the combined rack further comprises two first connecting assemblies and two second connecting assemblies, each of the two first connecting assemblies comprising a first connecting member, a second connecting member and a first fixing member, the two first connecting members are respectively disposed on two ends of the front plate that are opposite to each other, the two second connecting members are disposed on the left component and the right component respectively, the two second connecting members are configured to be movably combined with the two first connecting members respectively, the two first fixing members are pivoted on the two first connecting members, respectively, and are respectively configured for making the relative position adjustable, wherein each of the two second connecting assembly comprises a third connecting member, a fourth connecting member and a second fixing member, the two third connecting members are respectively disposed on two ends of the back plate are opposite to each other, the two fourth connecting members are disposed on the left component and the right component respectively and are configured to be movably combined with the two first connecting members respectively, the two second fixing members are pivoted on the two second connecting members respectively and are respectively for making the relative position adjustable.

2. The combined rack according to claim 1, wherein each of the front support structure and the back support structure is a groove.

3. The combined rack according to claim 1, wherein each of the front support structure and the back support structure is a block.

4. The combined rack according to claim 1, wherein each of the front support structure and the back support structure is a hook.

5. The combined rack according to claim 1, wherein each of the front support structure and the back support structure is a support sheet structure.

6. The combined rack according to claim 1, wherein two first sides of the front combining component that are opposite to each other respectively comprise a first combining portion and a second combining portion, the front plate is disposed on the first combining portion, two second sides of the back combining component that are opposite to each other respectively comprise a third combining portion and a fourth combining portion, the back plate is disposed on the third combining portion, two third sides of the carrying member that are opposite to each other respectively face the front combining component and the back combining component, and the two third sides of the carrying member that are opposite to each other are installed on the second combining portion and the fourth combining portion respectively.

7. The combined rack according to claim 6, wherein each of the first combining portion and the third combining portion is a block, each of the front plate front support structure and the back support structure comprises a fastening groove, and the two blocks are fastened with the two fastening grooves respectively.

8. The combined rack according to claim 6, wherein each of the first combining portion and the third combining portion is a fastening groove, each of front plate front support structure and the back support structure comprises a block, the two blocks are fastened with the two fastening grooves.

9. The combined rack according to claim 6, wherein each of the first combining portion and the third combining portion is a hook, each of the front support structure and the back plate the back support structure comprises a fastening groove, and the two hooks are respectively fastened with the two fastening grooves.

10. The combined rack according to claim 6, wherein each of the second combining portion and the fourth combining portion is a hook, each of the two third sides of the carrying member that are opposite to each other has a rod, the two hooks are respectively installed on the two rods.

11. The combined rack according to claim 6, wherein each of the second combining portion and the fourth combining portion is a hook, each of the two third sides of the carrying member that are opposite to each other has a fastening groove, the two hooks are respectively installed on the two fastening grooves.

12. The combined rack according to claim 6, wherein each of the second combining portion and the fourth combining portion is a support block, and the two third sides of the carrying member that are opposite to each other are respectively installed on the two support blocks.

13. The combined rack according to claim 6, wherein the second combining portion and the fourth combining portion are fixed to the two third sides of the carrying member that are opposite to each other, respectively.

14. A combined rack for connecting two sliding rails, comprising a front plate, a back plate, a left component, a right component and a carrying component, wherein the front plate, the back plate, the left component, the right component and the carrying component together form an accommodation space, the left component and the right component are configured for being installed on the two sliding rails respectively, in a slidable manner, the carrying component comprises a carrying member, a front combining component and a back combining component, a lower edge of the front plate comprises a front support structure, a lower edge of the back plate comprises a back support structure, the front combining component and the back combining component being connected to the carrying member, and the front combining component and the back combining component being installed on the front support structure and the back support structure, respectively;

wherein two first sides of the front combining component that are opposite to each other respectively comprise a first combining portion and a second combining portion, the front plate is disposed on the first combining portion, two second sides of the back combining component that are opposite to each other respectively comprise a third combining portion and a fourth combining portion, the back plate is disposed on the third combining portion, two third sides of the carrying member that are opposite to each other respectively face the front combining component and the back combining component, and the two third sides of the carrying member that are opposite to each other are installed on the second combining portion and the fourth combining portion respectively;

wherein each of the first combining portion and the third combining portion is a hook, each of the front support structure and the back support structure comprises a fastening groove, and the two hooks are fastened with the two fastening grooves.

* * * * *